United States Patent [19]

Powers

[11] 4,045,211

[45] Aug. 30, 1977

[54] METHOD FOR INCREASING RADIANT HEAT TRANSFER FROM HOT GASES

[75] Inventor: Richard Mather Powers, Guthrie, Ariz.

[73] Assignee: Phelps Dodge Corporation, New York, N.Y.

[21] Appl. No.: 650,809

[22] Filed: Jan. 20, 1976

[51] Int. Cl.[2] ..... C21B 5/02; C22B 15/00

[52] U.S. Cl. ..... 75/21; 75/40; 75/42; 75/72; 75/74; 75/23; 75/91

[58] Field of Search ..... 75/20, 21, 40, 41, 42, 75/43, 72, 74, 76, 91, 92, 93; 432/19, 20, 266

[56] References Cited

U.S. PATENT DOCUMENTS

| | | | |
|---|---|---|---|
| 1,931,927 | 10/1933 | Klees | 263/9 |
| 2,016,458 | 10/1935 | Schwalbe | 263/15 |
| 2,056,531 | 10/1936 | Morton | 263/52 |
| 2,084,830 | 6/1937 | Barnard et al. | 75/92 |
| 2,126,724 | 8/1938 | Boynton | 263/15 |
| 2,171,597 | 9/1939 | Parker | 263/52 |
| 2,287,785 | 6/1942 | Dean | 263/15 |
| 2,298,842 | 10/1942 | Richardson | 432/20 |
| 2,422,653 | 6/1947 | Breese et al. | 158/117.5 |
| 3,113,765 | 12/1963 | McGough | 263/15 |
| 3,146,089 | 8/1964 | Mayer et al. | 75/42 |
| 3,203,769 | 8/1965 | Sogawa et al. | 23/277 |
| 3,239,331 | 3/1966 | Menk et al. | 75/42 |
| 3,397,256 | 8/1968 | Paul et al. | 263/52 |
| 4,001,013 | 1/1977 | Goto et al. | 75/72 |

OTHER PUBLICATIONS

Wrampe, P. et al.; *Oxygen Utilization in Copper Reverbatory Furnace, Aime* (N.Y.), Feb. 1974, pp. 1-15.

*Modern Metals,* June 1975; "New and Improved Fuel Saving Equipment . . . ," June 1975, pp. 55-71.

*Primary Examiner*—Walter R. Satterfield

*Attorney, Agent, or Firm*—Alfred L. Michaelsen; Lawrence W. Flynn

[57] ABSTRACT

Radiant heat transfer is increased by introducing to hot gases, such as those normally present in furnaces, a material which provides finely sized particles therein of the type which increase the emissivity and luminosity of the gases. The material is introduced separately from the furnace fuel and preferably downstream of the flame produced by the burning of the fuel. In one embodiment, an unsaturated gaseous hydrocarbon such as acetylene is introduced into the furnace at a plurality of locations downstream of the flame. The unsaturated hydrocarbon exothermically cracks in the furnace to produce hydrogen and carbon particles in the furnace hot gases. The carbon particles increase the emissivity and luminosity of the hot gases and thus their radiant heat transfer to the furnace charge. The exothermic cracking reaction and the combustion of the hydrogen produced during cracking add heat to the hot gases which maintains their temperature at desired levels despite the increased radiant heat transfer from the gases. By varying the locations where the hydrocarbon is introduced, as little or as much of the furnace hot gases as desired can be made luminous. Under preferred conditions, radiant heat transfer to the furnace charge can be increased 20% or more by the method of the invention.

4 Claims, 7 Drawing Figures

ADDITIVE 45
ADDITIVE 45
BURNERS

METHOD FOR INCREASING RADIANT HEAT TRANSFER FROM HOT GASES

BACKGROUND OF THE INVENTION

This invention relates broadly to a method for more efficiently utilizing heat in furnace operations. More particularly, it relates to a method for substantially increasing the emissivity and luminosity of furnace hot gases so that they become better radiators of heat to the furnace charge. This permits heat which otherwise would leave the furnace with the exhaust gases to be utilized in the furnace, thus substantially increasing the economies of furnace operation. The invention, although described herein in terms of a reverberatory furnace, finds utility in any application where a substance is being at least partly heated by radiation from a gas which is at a higher temperature than the substance.

Furnaces and their efficient and economical operation are an important aspect of many commercial manufacturing processes. They are widely used, for example, in the pyrometallurgical processing of mineral ores. The reverberatory and open-hearth furnaces used in the production of copper and steel are but two well-known examples of important industrial furnaces. These furnaces normally operate at very high temperatures, e.g., 1000° to 3000° F., depending upon such factors as their particular function and the nature of the material being processed. They are huge consumers of energy in the form of the fuel which is required to fire such furnaces.

In many furnaces, the heat is supplied by burning a fuel in proximity to a bed of the substance which is being treated in the furnace. This substance is often referred to as the "furnace charge" or "charge." This burning normally produces a highly visible flame in a part of the furnace generally referred to as the "combustion zone," and hot combustion gases throughout the rest of the furnace. The charge is heated in large part by the heat transferred to it by radiation from the flame and hot combustion gases.

The method of this invention and the problems it is intended to overcome are conveniently demonstrated by consideration of a conventional industrial reverberatory furnace of the type used, for example, to process and melt copper ores. A typical reverberatory furnace of this type is shown in FIG. 1.

The furnace 10 contains an elongated refractory-lined chamber 11 having a relatively high length to height ratio. The ore 12, for example a copper concentrate, is fed to the furnace through the refractory roof 13 from feed hoppers 13a and deposited on the furnace hearth 14 between the banks 14a (see FIG. 3) on each side of the furnace. FIG. 1, for reasons of clarity, shows burners 15 at only one end of the furnace. Those skilled in the art will appreciate, however, that in many such furnaces, there are burners at each end for cyclic firing of the furnace, first from one end and then from the other.

An oxidant 16, usually air, and a fuel 17, such as natural gas, oil or various other energy sources, are fed to the burners 15 where they are mixed in desired proportions. The fueloxidant mixture is injected into the furnace interior 11 through ports 18 located approximately midway in the furnace end wall 19. As the mixture enters the furnace, it ignites to produce a distinct visible flame 20 at one end of the furnace. This flame normally extends only part way down the length of the furnace and generally delineates the zone of combustion. Enough burners are usually provided to maintain a substantially continuous flame front across the width of the charge 22.

In conventional furnace operation, flame 20 can extend from about one-fifth to one-third of the way down the furnace length, as shown in FIG. 1. The disappearance of flame 20 part-way down the furnace indicates that fuel combustion has been substantially completed at that point. The remaining portion of the furnace downstream of flame 20, generally designated as 24, is filled with hot furnace combustion gases which normally are relatively invisible or transparent as compared to the flame 20. These gases pass through the furnace over the charge as generally designated by the arrows in FIG. 1. Typical temperature present in a reverberatory furnace of this type range from about 2100° to 2700° F., and typically from about 2200° to 2600° F.

The flame 20 and hot combustion gases radiate heat to the charge 22. This heat, plus that radiated from the furnace roof 13, converts the charge 22 (i.e., the fresh ore 12) to the molten state. The ore then separates into a heavier matte layer 25 enriched in copper values, and a lighter slag layer 26 depleted in copper values. These layers are separated in conventional fashion by tapping the furnace.

The hot exhaust gases 27 exit the furnace through an outlet 30. Unfortunately, the heat radiation characteristics of the hot furnace gases leave much to be desired. As a result, only a fraction of the heat values of these gases is radiated to the charge 22 in the zone 24 downstream of flame 20. The remaining heat values are retained in the hot gas and leave the furnace with the exhaust gases 27. In many operations, the heat present in the exhaust gases is so significant, e.g., as much as 30 to 40% of the heating value of the fuel 17, that it becomes economically necessary to recover it. This can be done by passing the hot exhaust gases 27 through checkers, waste heat boilers, or other heat regeneration means (not shown in FIG. 1).

It is apparent, therefore, that heat utilization within the furnace itself is quite inefficient. This problem has recently become of even more serious concern because of the drastically increased cost of energy, and the potential future shortage of energy sources.

A major problem confronting those who would improve the thermal efficiency of such furnaces is how to make the hot furnace gases give up more of their heat by radiation to the furnace charge as they pass through the furnace.

The mathematical equations and variables which effect the rate of heat transfer from a hot substance (the furnace gases) to a cooler one (the furnace charge) by a radiation mechanism have been known for years. See, for example, *Industrial Furnaces* by Trinks and Mawhinney, Volume 1, 5th Edition, Wiley and Sons (1961), pages 44 and 50 (hereinafter "Trinks and Mawhinney"). For example, the amount of radiant heat transfer in a furnace can be increased by increasing the temperature of the furnace gases since the amount of heat transferred by radiation is known to be directly proportional to the value of:

$$(T_g)^4 - (T_c)^4$$

where $T_g$ is the temperature of the hot gases and $T_c$ is the temperature of the charge. Normally, however, an increase in hot gas temperature would only necessitate greater instead of lesser fuel consumption. Furthermore, the operating temperatures of many industrial furnaces are normally relatively fixed by factors such as the nature of the material being processed, the materials of construction used in the furnace, and the like.

It is also known that the amount of heat radiated from the hot gases to the charge can be increased by increasing the emissivity of the hot gases. The emissivity of a gas is a measure of the rate at which the gas radiates heat in relation to an arbitrarily defined norm or standard for perfect or complete heat radiation called a "black body." Each gas can be assigned a numerical emissivity factor which can vary from a value of almost zero to slightly less than 1.0. A value of about zero means that the gas radiates virtually no heat while a value of about 1.0 means it radiates heat at about the same rate as a black body. Thus, as the value of the emissivity factor of a gas increases, the amount of radiant heat transfer from the gas also increases. A desirable objective then would be to increase the emissivity of the hot furnace gases. Those skilled in the art often refer to flames or gases of high emissivity as being "luminous" and those of low emissivity as being "non-luminous." In general, a luminous gas in the context of furnace operation is one that is opaque to varying degrees, while a non-luminous gas is one which is essentially clear or transparent. The properties of emissivity and luminosity are often used interchangeably in the prior art, apparently because of the general belief that the luminosity of a gas is usually directly proportional to its emissivity.

A generally recognized separation point between gases of low and high emissivity occurs at an emissivity factor of about 0.3. For example, furnace hot gases whose emissivity factors are below about 0.3 are generally regarded as being of low emissivity or non-luminous, while those whose emissivity factors are above about 0.3 are generally regarded as being of high emissivity or luminous. For practical purposes, emissivity factors of above about 0.6 are preferred.

There are many known techniques for increasing the emissivity or luminosity of a gas. See, for example, *The Science of Flames and Furnaces* by M. W. Thring, 2nd Edition, Wiley and Sons (1968), particularly pp. 314–357 (hereinafter "Thring"). For example, the addition of finely divided solid particles to a gas will normally increase its emissivity and radiant heat transfer (see Thring, page 321). These particles can be generated in a number of ways, including the incomplete combustion and cracking of hydrocarbons (see Thring, page 322). U.S. Pat. No. 2,126,724 teaches at column 1, lines 11–27, that radiant heat transfer in a furnace is greatly promoted by a luminous burner flame, and that such luminosity can be provided by mixing minute particles of carbon with the fuel fed to the furnace. The particles are heated to incandescence in the burner flame and give the flame its luminous appearance. However, one problem with this approach is that the cooling effect of the heat capacity of the particles is significant and could lower the flame temperature to the point where any increased radiation resulting from the particles is more than offset by the reduction in radiation produced by the lower flame temperature (see Thring, page 321).

In the case of certain furnace fuels, flame emissivity and luminosity can be increased by altering the fuel-oxidant ratio. See, for example, the discussion by Trinks and Mawhenney at page 44, where it is pointed out that a burner flame of higher emissivity is produced when the fuel-oxidant mixture contains excess natural gas as opposed to excess air. These conditions crack the hydrocarbons in the fuel to carbon particles which increase the emissivity of the burner flame. However, as the fuel is combusted, eventually no new carbon particles are produced while those that have been produced are gradually burned away. Finally a point is reached where all the carbon particles have been burned at which time the flame extinguishes. The emissivity then drops sharply. Since the burner flame extends only part-way down the furnace, the region of high emissivity exists in only a short section of the furnace.

The emissivity of the burner flame is also known to depend on the chemical nature of the fuel used. For example, Thring points out at pages 337–338 the significant effect of the carbon to hydrogen weight ratio of the fuel upon the emissivity of the flame produced by the combustion of the fuel.

While the above general principles are helpful, problems have arisen in usefully applying them to large industrial furnaces. Numerous attempts have been made to provide within the furnace hot gases an environment of finely sized particles in the hope of improving the radiant heat transfer from the gases to the charge. For example, U.S. Pat. Nos. 2,126,724, 2,298,842 and 3,345,054 disclose techniques for mixing finely divided carbon particles with the furnace fuel before it enters the furnace. The carbon particles are provided by thermally cracking a system of hydrocarbon gas in a cracking chamber outside the furnace, and then mixing the outlet stream from the cracking chamber (which includes the carbon particles) with the furnace fuel before it enters the furnace. The objective is to provide carbon particles in the burner flame so it will be more emissive and luminous, thereby radiation more of its heat to the charge.

There are several drawbacks to mixing the carbon particles with the burner fuel. First, a separate hydrocarbon cracking system separate from the furnace and complete with its own cracking vessel, etc., is required. Secondly, finely sized carbon particles have a tendency to agglomerate. Larger size particles do not enhance flame emissivity to the extent that smaller particles do. Since the carbon particles are generated outside the furnace, there is a delay between their generation and introduction into the furnace, during which particle agglomeration could occur. Finally, and probably most important, the carbon particles will at most only increase the emissivity and luminosity of the burner flame 20 (see FIG. 1). As pointed out above, this flame extends at most only about one-third the way down the furnace. Since the carbon particles will be consumed or burned up in the flame (see Trinks and Mawhenney, page 44), substantially none or very few will carry into the remaining two-thirds of the furnace (zone 24 in FIG. 1) where a substantial amount of the charge heating takes place. Therefore, the emissivity and luminosity of the hot furnace gases downstream of the flame will not be increased by the injection of carbon particles. Since these downstream hot gases do a lion's share of heating the furnace charge, the limitations of mixing carbon particles with the fuel become evident.

These limitations are appreciated by those skilled in the art. As Thring states on page 347: "Unfortunately, there is at present no known way of producing flames where the emissivity is maintained high throughout the length of the furnace while combustion is completed in the first third." Thring goes on to note later on page 347: "There is, however, clear scope for improvement if a method can be found for maintaining the emissivity of a flame at a fairly high level even though combustion is effectively complete, e.g., by producing soot particles which do not disappear for some time after the remainder of the fuel is fully burned out."

It is thus the inability to maintain the emissivity of the furnace hot gases at a high level throughout the portions of the furnace downstream of the flame or combustion zone which has posed a major obstacle to the more efficient extraction and utilization of the heat value of the hot gases while still within the furnace. It is toward the solution of this problem that the present invention is directed.

It is, therefore, an object of this invention to provide a method to increase the emissivity of furnace hot gases, and consequently their radiant heat transfer to the furnace charge, and to maintain the increased emissivity throughout the furnace environment.

It is another object of this invention to provide a method to increase the emissivity of furnace hot gases in the region of the furnace downstream of the burner flame.

It is another object of this invention to provide a method to selectively increase the emissivity of the furnace hot gases at one or more different locations in the furnace, as desired, including locations downstream of the burner flame.

It is another object of this invention to provide a method to increase the emissivity of furnace hot gases by providing and maintaining an atmosphere of carbon particles in the gases downstream of the burner flame.

It is another object of this invention to provide a method to increase the emissivity of furnace hot gases by providing carbon particles therein, but where the particles originate from a source other than the fuel injected into the furnace.

It is another object of this invention to provide a method to increase the emissivity of furnace hot gases by generating carbon particles within the furnace, downstream of the combustion zone of the furnace.

It is another object of this invention to provide a method to increase the emissivity of furnace hot gases by providing carbon particles therein while at the same time adding heat to the hot gases.

It is a further object of this invention to provide a method to increase the emissivity of furnace hot gases by providing carbon particles therein without substantially decreasing the temperature of the hot gases because of heat transfer from the hot gases to the particles.

It is a general object of this invention to provide a method for increasing the amount of heat radiated by furnace hot gases to a furnace charge.

It is another general object of this invention to provide a method to improve the thermal efficiency of the radiant heat transfer in a furnace in which the charge is at least partly heated by radiation from hot gases.

It is another general object of this invention to provide a method of furnace operation whereby the quantity of furnace fuel consumed per unit of charge is decreased, thereby permitting the economies of lower fuel consumption or increased furnace through-put at no added cost.

These and other objects of the invention will be apparent to those skilled in the art from a consideration of this entire specification and the accompanying drawings.

SUMMARY OF THE INVENTION

The above objectives are accomplished by introducing to the furnace, at one or more locations away from or outside of the burner flame, and preferably downstream of the flame, a material which will provide in the furnace hot gases finely sized particles which increase the emissivity and luminosity of the gases. The material is introduced into the furnace separately from the furnace fuel and in an amount effective to increase the emissivity of the hot gases. Preferably sufficient material is used to increase the emissivity factor of the hot gases to a value above about 0.3, and even more preferably to about 0.6 or higher. The material is preferably one which will generate carbon particles in situ within the furnace.

In one preferred embodiment, an unsaturated hydrocarbon gas is introduced into the furnace at one or more locations downstream of the burner flame. At the conditions prevailing in the furnace, primarily the very high temperatures, the hydrocarbon undergoes an exothermic cracking reaction to yield hydrogen and finely sized carbon or soot particles in the hot gases. The hydrogen then combusts with oxygen present in the hot gases. The exothermic cracking and the combustion of the hydrogen add heat to hot gases. Furthermore, the carbon particles which are responsible for increasing the emissivity of the hot gases are generated directly within the hot gases and at substantially the same temperature as the hot gases. Thus, the emissivity of the hot gases is desirably increased by a mechanism which does not drain heat from the gases. In fact, heat is added to the gases by the mechanism of carbon particle generation which is used. The result is that little of the heat carried by the hot gases is transferred to the carbon particles while at the same time the hot gases are actually being heated by the energy released by the cracking and combustion reactions. This assists significantly in keeping the temperature of the hot gases at acceptably high levels despite the heat drain resulting from the increased emissivity of the hot gases. As a result, the net rate of radiant heat transfer from the hot gases to the charge can be increased as much as 20% or more. This translates to a reduction of 20% or more in burner fuel consumption per unit of charge processed. Moreover, it reduces the need for heat regeneration systems downstream of the furnace to recover the heat content of the hot furnace gases.

The material which is to provide the carbon particles can be introduced to the hot furnace gases at any convenient location in the furnace through the use of appropriately positioned lances or other suitable injecting means. Similarly, the amount of material introduced at each location can be varied as desired, to produce the degree of increased emissivity needed. Thus, the method of the invention flexibly permits the emissivity of all or only a portion of the furnace hot gases to be increased.

As can now be appreciated, the method of the invention permits the emissivity of the furnace hot gases to be increased through the region of the furnace downstream of the burner flame while at the same time adding heat to these hot gases. This is accomplished by introducing the material which is to provide the finely sized particles independently of the burner fuel. Thus the material is introduced as a separate furnace feed stream from a source separate and distinct from the furnace fuel. Consequently the point at which it is introduced to the furnace can be selected without regard for the location where the fuel is injected. This permits the material to be introduced outside the combustion zone, in the region of the furnace downstream of this zone where the maintenance of an environment of finely sized particles, and hence increased emissivity of the hot gases, has been a problem.

The method of the invention finds useful application, as those skilled in the art will appreciate, in virtually any situation where a substance is being heated at least in part by radiation from a gas whose temperature exceeds that of the substance. Included among these numerous possibilities are the reverberatory furnaces used to process copper ores and the open hearth furnaces used in steel-making.

The invention is more fully described below in conjunction with the preferred embodiments thereof, and the accompanying drawings.

DESCRIPTION OF THE PREFERRED EMBODIMENTS

Figure 1:
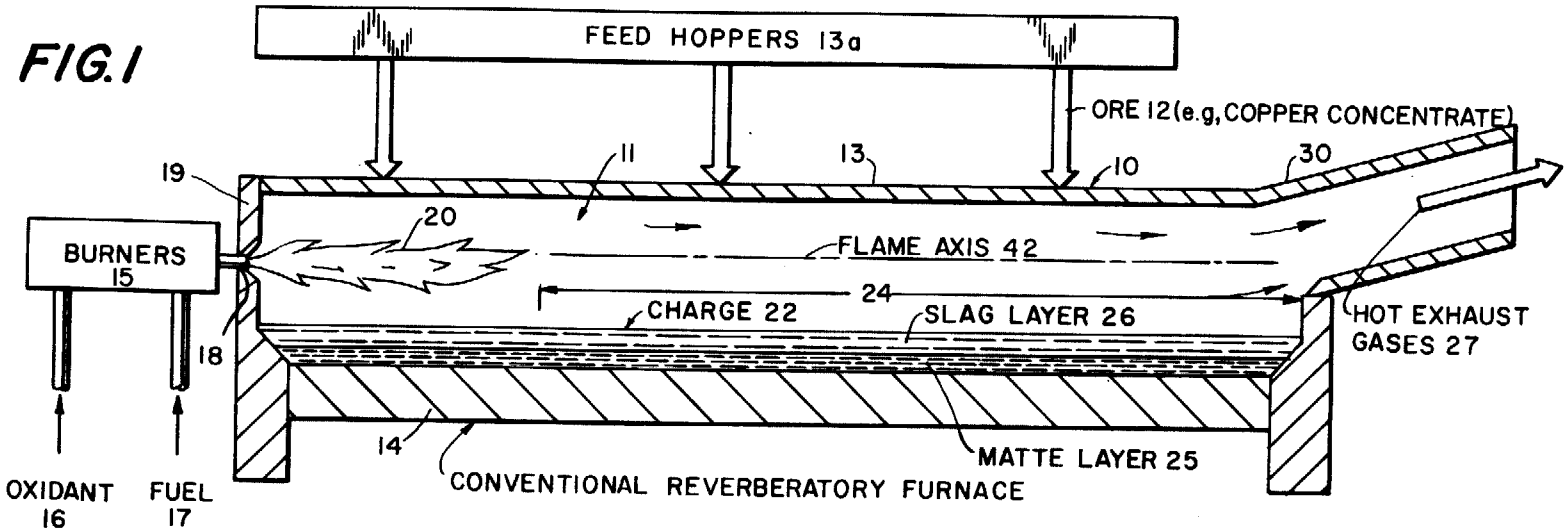
FIG. 1 is a schematic side sectional view of a conventional reverberatory furnace of the type commonly used in the processing of copper and other metal ores.

As discussed above, FIG. 1 shows a conventional reverberatory furnace. FIGS. 2–5 illustrate the use of the method of the invention to increase the emissivity of the hot gases in the region of the furnace downstream of the burner flame 20. The identifying numerals in FIG. 1 have also been used in FIGS. 2–5.

Figure 2:
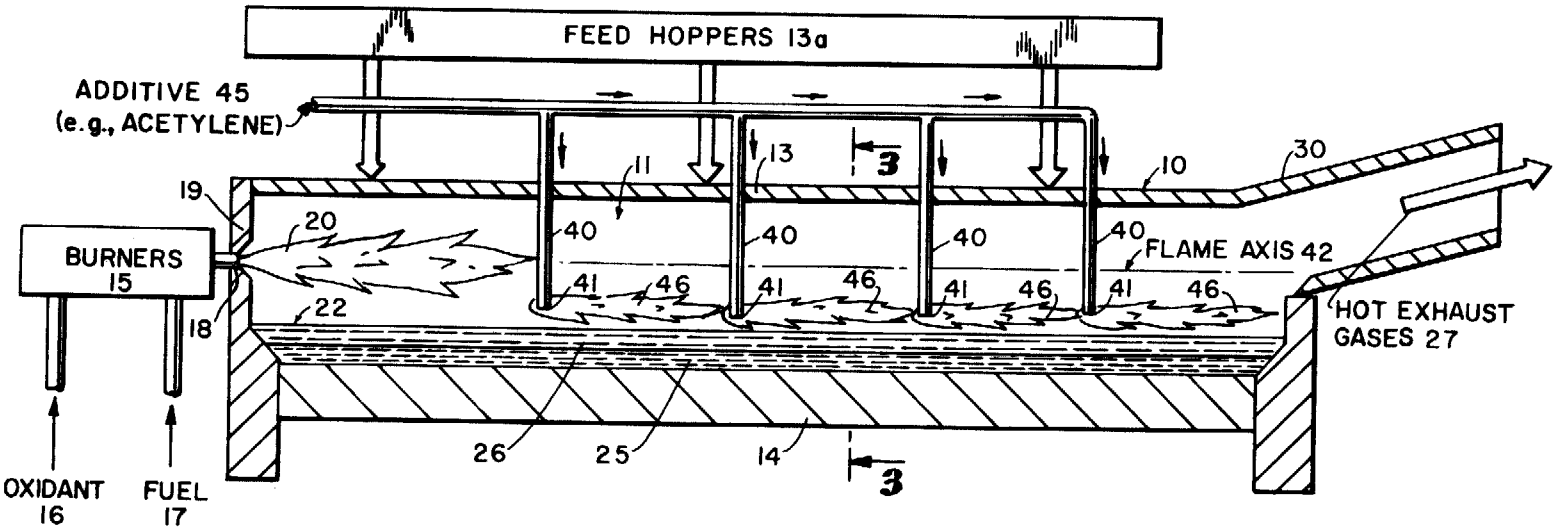
FIG. 2 is a view of the furnace of FIG. 1, further illustrating the use of the method of the invention in said furnace.
Figures 3, 4, 4A:
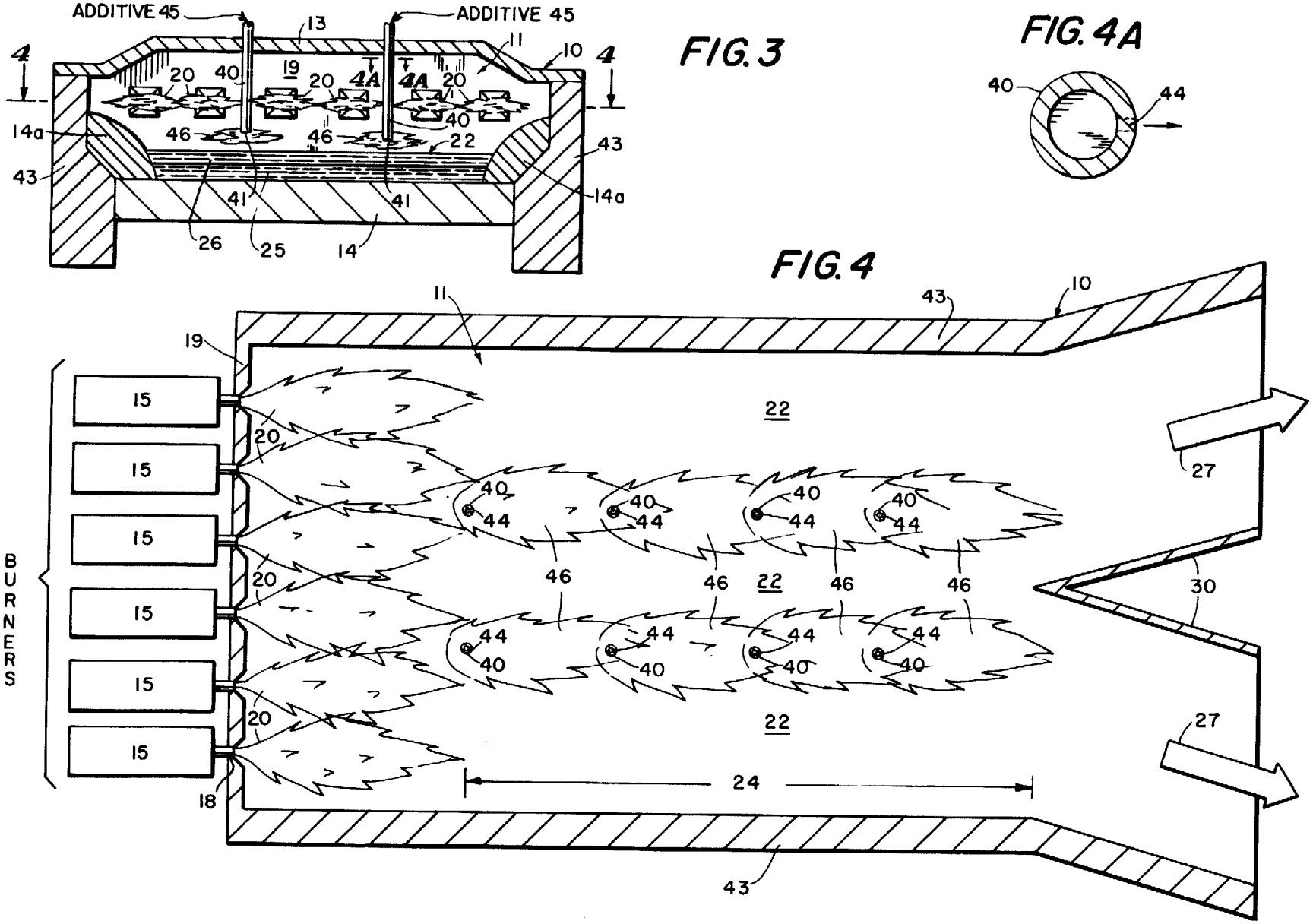
FIG. 3 is a sectional view taken along the line 3—3 of FIG. 2
FIG. 4 is a sectional view taken along the line 4—4 of FIG. 3.
FIG. 4A is an enlarged sectional view taken along the line 4A—4A of FIG. 3.
Figure 5:
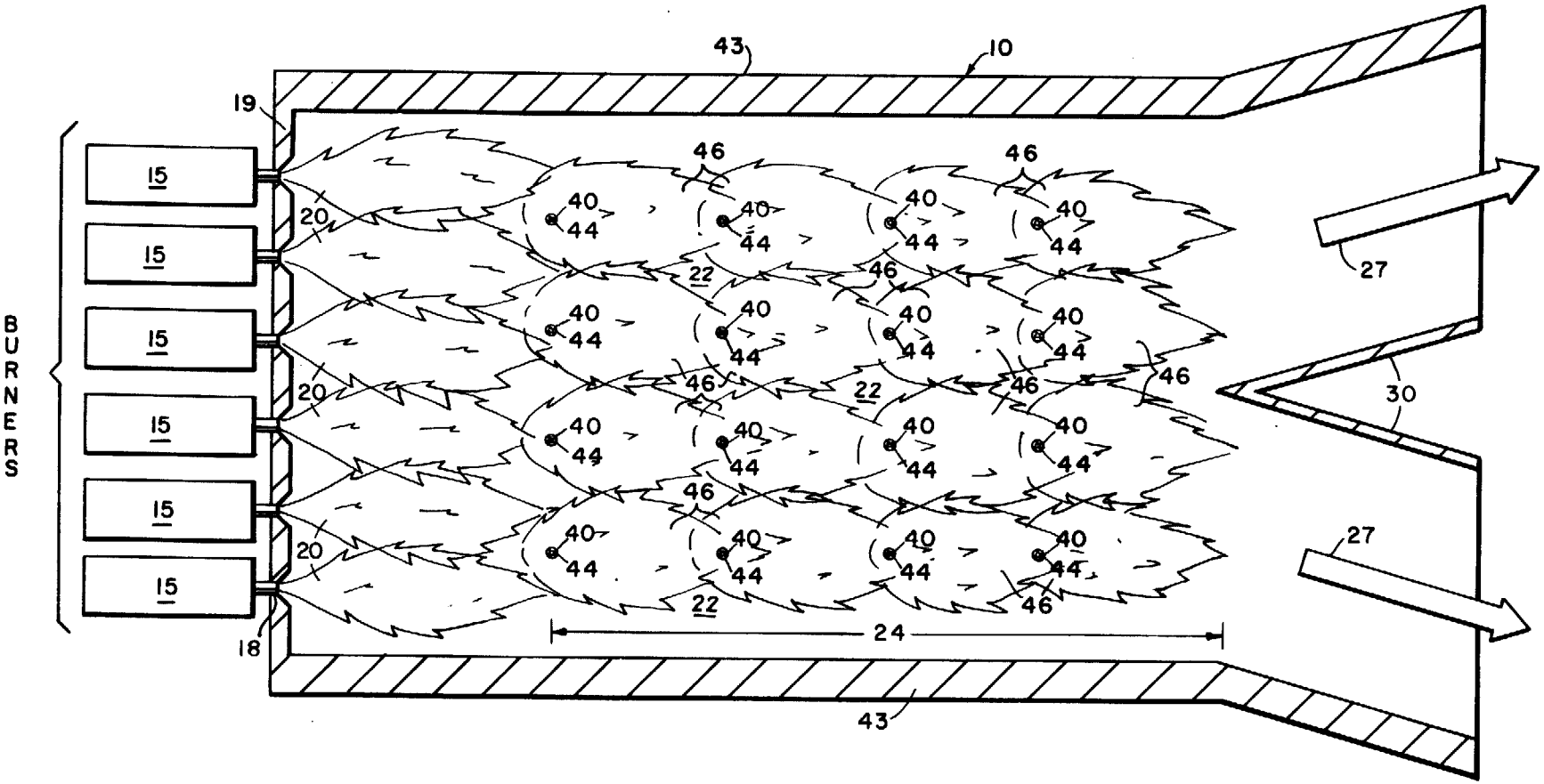
FIG. 5 is a view similar to FIG. 4 except it shows four rows of injection lances instead of two.

Referring to FIG. 2, the furnace 10 is provided with a plurality of conventional water-cooled hollow injection lances 40 which protrude through the furnace roof 13 into its interior. The additive 45 which is to provide the particles which increase the emissivity of the furnace hot gases is introduced to the furnace by these lances. The lances are positioned at various spaced locations in the region 24 (see FIG. 1) downstream of the burner flame 20 to provide a matrix or grid of injection locations throughout the furnace interior, as best seen in FIGS. 4 and 5. It is apparent that as many or as few injection lances as needed can be employed, and that their location can be varied within the furnace interior 11 as desired. The lances can be vertically oriented as shown in FIG. 2 or at any other suitable angular location. Moreover, the lances 40 can enter the furnace at any convenient location other than through the roof 13.

The tips 41 of the lances are generally spaced from, but in close proximity to, the charge 22. Tips 41 are normally positioned closer to the charge 22 than to the roof 13, and preferably below the axis 42 of flame 20. This is to minimize undesirable interaction between the materials introduced through the lances and the charge 22 or roof 13 of the furnace. Illustratively, tips 41 are positioned at a distance above charge 22 which is at least about 10% of the height of the furnace (from charge to roof) at the location of tip 41, and at a distance below the roof which is at least about 25% of the same furnace height. In a typical industrial reverberatory furnace, the tip would be at least about 2 feet above the charge 22 and at least about 5 feet below the roof 13.

The openings 44 (see FIG. 4A) in tips 41 through which material 45 is discharged can be oriented to introduce material 45 into the furnace interior 11 in virtually any direction, e.g., toward the furnace side walls or roof, toward the charge 22 or in an upstream or downstream direction. Preferably the openings 44 are oriented to direct the material 45 in a generally downstream direction, as shown in FIGS. 4 and 5.

The material 45 introduced in the furnace interior through lances 40 provides finely sized particles throughout the furnace hot gases. This increases the emissivity of the hot gases in the region 24 downstream of the burner flame 20 and consequently causes the gases to radiate substantially more of their heat to the charge 22.

Material 45 is preferably a hydrocarbon in any physical form which will thermally crack under the conditions prevailing in the furnace to yield carbon particles of the type which will increase the emissivity of the hot gases. Illustratively, such hydrocarbons have a high carbon content, e.g., a carbon to hydrogen weight ratio of at least about 3 or higher, and preferably as high a carbon to hydrogen weight ratio as possible consistent with other considerations such as the availability, cost and effectiveness of the material in enhancing the emissivity and radiant heat transfer of the hot gases.

More preferably, material 45 is an unsaturated gaseous hydrocarbon which exothermically cracks at the conditions prevailing in the furnace to yield hydrogen and carbon particles of very fine size, and whose carbon to hydrogen weight ratio is at least about 6, and preferably at least about 8. Acetylene, whose carbon to hydrogen weight ratio is 12, is one example of such a material.

The particular hydrocarbon used is not important provided it will crack to fine carbon particles once in the furnace. Illustrative hydrocarbons include unsaturated straight chain hydrocarbons such as ethylene, 2-butene, propylene and isobutylene, as well as unsaturated aromatics such as benzene. Material 45 can, of course, be a mixture of two or more different materials.

As the hydrocarbon issues from the tips 41 of lances 40, it is directed in a downstream direction at substantially right angles to the lances. Once the hydrocarbon enters the furnace interior 11, it flames producing an elongated flame 46 at each lance, as shown in FIG. 2. The hydrocarbon diffuses above and below, and to each side of its point of introduction as it flames and is swept downstream.

As the hydrocarbon 45 enters the furnace, it contacts the furnace hot gases which are at extremely high temperatures, e.g., 2100° to 2700° F. Under these conditions, the hydrocarbon exothermically cracks to hydrogen and carbon particles. The hydrogen in turn reacts with oxygen present in the furnace hot gases in a combustion reaction to produce water vapor. Most furnace hot gases contain some oxygen for reaction with the hydrogen as the result of incomplete fuel combustion, the use of excess oxidant, or other reasons.

The heat from the exothermic cracking of the hydrocarbon and from the combustion of hydrogen represents a heat input to the furnace hot gases which help them to maintain desirably high temperatures despite the carbon formation and the increased emissivity of the gases.

The carbon particles produced by the cracking reaction are distributed in the furnace hot gases. The region of highest carbon particle concentration is in flame 46 and the immediately surrounding environment. In the portions of the furnace more remote from flame 46, the concentration of carbon particles is normally somewhat lower. In the embodiment shown in FIG. 2, the region of highest carbon particle concentration is the lower portion of the furnace, from about the height of lance tips 41 downward. The region of lowest carbon particle concentration is the upper portion of the furnace, from about the flame axis 42 upward. A region of intermediate carbon particle density is located between the lance tips 41 and the flame axis 42. There is ordinarily no clear line of demarcation between these regions. In most instances, there will be a gradient of carbon particle concentration throughout the furnace interior, with the higher concentration being in proximity to the location where material 45 is introduced to the furnace.

Since more of the heat radiated from the hot gases closer to charge 22 will strike the charge than will heat radiated from the more distant hot gases (because of the higher view factor of the closer hot gases), it is desirable to provide the height carbon particle concentration in the gases closer to the charge. This provides the greatest increase in emissivity at a location in the furnace where a higher proportion of the increased radiant heat transfer caused by the carbon particles will strike the charge. At the furnace locations more distant from the charge, more of the heat radiated from the hot gases tends to strike the furnace roof, walls and other portions thereof. This is another reason why it is preferred to introduce material 45 in close proximity to the charge 22. The concept of the view factor of a hot gas is explained in *Heat Transmittion* by William H. McAdams, McGraw-Hill Book Co. (1954), pages 63–69.

While unsaturated gaseous hydrocarbons represent preferred sources of the emissivity-increasing particles, other materials can also be used. Illustrative materials include solids such as finely-sized carbon particles, soot, carbon black or the like, and liquids such as fuel oil, benzene and other hydrocarbons. Solids and liquids are preferably pre-heated prior to introducing them into the furnace in order to reduce their tendency to withdraw heat from the furnace hot gases, thereby undesirably lowering the temperature of these gases. Liquids additionally are preferably atomized or otherwise subdivided prior to their introduction to the furnace to facilitate rapid and efficient vaporization.

The size of the particles provided in the furnace hot gases by material 45 has a bearing on the degree of increased emissivity which is imparted to the gas. Smaller sized particles are preferred since their effect in increasing emissivity is usually greater than that of larger particles. In general, a soot-like texture or appearance is indicative that the particles are of sufficiently small size to increase emissivity. Particles having an average size of less than about 1 micron, and preferably substantially less than 1 micron, e.g., below about 0.1 micron, are quite satisfactory for increasing the emissivity and luminosity of hot furnace gases. Carbon particles are preferred. In this regard, the gaseous unsaturated hydrocarbons are particularly useful because they crack to produce finely sized, sooty, carbon particles with excellent emissivity-increasing characteristics.

The amount of material 45 which is used can vary considerably depending upon such factors as the emissivity of the hot gases it is introduced into, the desired increase in emissivity, and the characteristics of material 45. In general, a sufficient amount of material 45 is used to increase the emissivity of the hot gases. While there is no upper limit on the amount of material 45, it will be apparent that if too much material is used, any savings in fuel costs would be off-set by the cost of material 45.

Illustratively, the amount of material 45 used is about 0.5 to 15%, and preferably about 1 to 10%, of the amount of fuel used, on a weight basis. For example, if the burner fuel is injected at the rate of 100 weight units per unit time, the amount of material 45 used would be about 0.5 to 15 weight units per the same unit time. For the case where the burner fuel and material 45 are each gaseous, material 45 is preferably introduced to the furnace in an amount representing about 1 to 10%, and even more preferably about 2 to 5%, of the volume of burner fuel. The objective is normally to use as little of material 45 as possible to produce the desired increase in the emissivity of the hot gases.

The above figures on the amounts of material 45 which are used refer to the aggregate amount from all the input locations when material 45 is introduced into the furnace at a plurality of locations. For example, if 10 locations were used, the 0.5 to 15% figure given above would include the total amount of material introduced to the furnace from all 10 locations.

A comparison of FIGS. 4 and 5 demonstrates the flexibility of the present invention. Thus as much or as little of the furnace hot gases as desired can be treated simply by using more or fewer lances. The two column arrangement of lances in FIG. 3 does not provide lateral overlapping between the hydrocarbon flames 46 whereas the four column arrangement in FIG. 4 does, thereby increasing the emissivity of substantially all the furnace hot gases in the region 24 downstream of the burner flame 20. Illustratively, anywhere from about 1 to 20, and preferably about 2 to 10, lances would be employed in most industrial furnaces.

As can now be appreciated, the present invention permits an environment of carbon particles to be provided wherever desired in the furnace, including the extensive region downstream of the flame. These particles can be generated in situ within the furnace from a source other than the burner fuel, and by a mechanism which adds heat to the hot gases. The net result is a substantial increase in the radiant heat flux in the furnace which enables more of the heat to transfer from the hot gases to the charge.

The following example is provided to further illustrate the invention.

EXAMPLE

The invention was demonstrated in a specially designed furnace having a width of 9 inches, a height of 15 inches and a length of 36 inches. A gas burner was placed at one end of the furnace and a flue at the other end. A sight port at the gas burner end and another about two thirds the distance downstream along the furnace side wall permitted observation of the furnace interior.

A calorimeter was built into the floor of the furnace. The calorimeter was a water-filled iron box 9 inches wide, 15 inches long and ⅞ inch thick with insulated inlet and outlet leads for passing a liquid through it. Water cooled lances were provided in the roof of the furnace to permit injection of gaseous acetylene or other additives into the furnace at points downstream of the burner flame. These lances were located centrally between the side walls of the furnace.

During operation of the furnace, water was passed through the calorimeter to measure the heat transferred to the furnace bottom by radiation from the hot furnace gases provided by the combustion of the fuel fed to the burner. The temperature rise or Δ T of the water was recorded as the output of a differential thermocouple. Furnace operation was initiated by supplying natural gas to the burner at a measured rate and igniting it to produce a flame at one end of the furnace. Operation was continued until the temperature rise of the water passing through the calorimeter had leveled off. At this point, the average temperature in the furnace measured about 1020° C. (1868° F.)

Gaseous acetylene was then injected into the furnace through the roof lances using calibrated peristaltic pumps to control the volume of addition. The acetylene was metered into the furnace at an aggregate volumetric flow rate for all the lances of about 3.8% the volumetric flow rate of the natural gas being fed to the burner.

Visual observation of the acetylene injection points revealed an elongated flame in proximity to each injection point, as shown in FIG. 2. Shortly after acetylene injection was initiated, the temperature rise of the water passing through the calorimeter began to increase. After 10 minutes of continued acetylene injection at the above rate, the temperature rise of the calorimeter water had increased about 10%. The acetylene injection was then terminated at which time the temperature rise of the water began to drop, eventually reaching about the same level as before the initiation of acetylene injection.

The portion of the 10% increase in temperature rise attributable to the heat input to the system from exothermic cracking of the acetylene and the subsequent combustion of the hydrogen produced by the cracking reaction was computed by conventional thermodynamic calculations to be a maximum of about 2.3%. Thus the major portion of the observed rise in temperature of the calorimeter water was attributable to increased radiation of heat from the hot furnace gases caused by injection of the acetylene.

The amount of heat radiated from the hot furnace gases to the furnace bottom (where the calorimeter was located) was increased at least about 7.7% by the injection of acetylene. This is heat which otherwise would leave the furnace with the hot gases. In a reverberatory furnace (see FIGS. 1-2), the ore charge occupies the same location as the calorimeter in this example.

Further experimentation conducted upon the occasion of this invention has led to the discovery of a particular mixture of gases for the material 45, which mixture has been found to be especially productive of a highly luminous flame which, in turn, provides a very substantial increase in radiant heat transfer. Specifically, I have found that a mixture of methane and oxygen, in a high methane to oxygen mixture, can result in increasing radiant heat transfer by as much as 100%.

Figure 6:
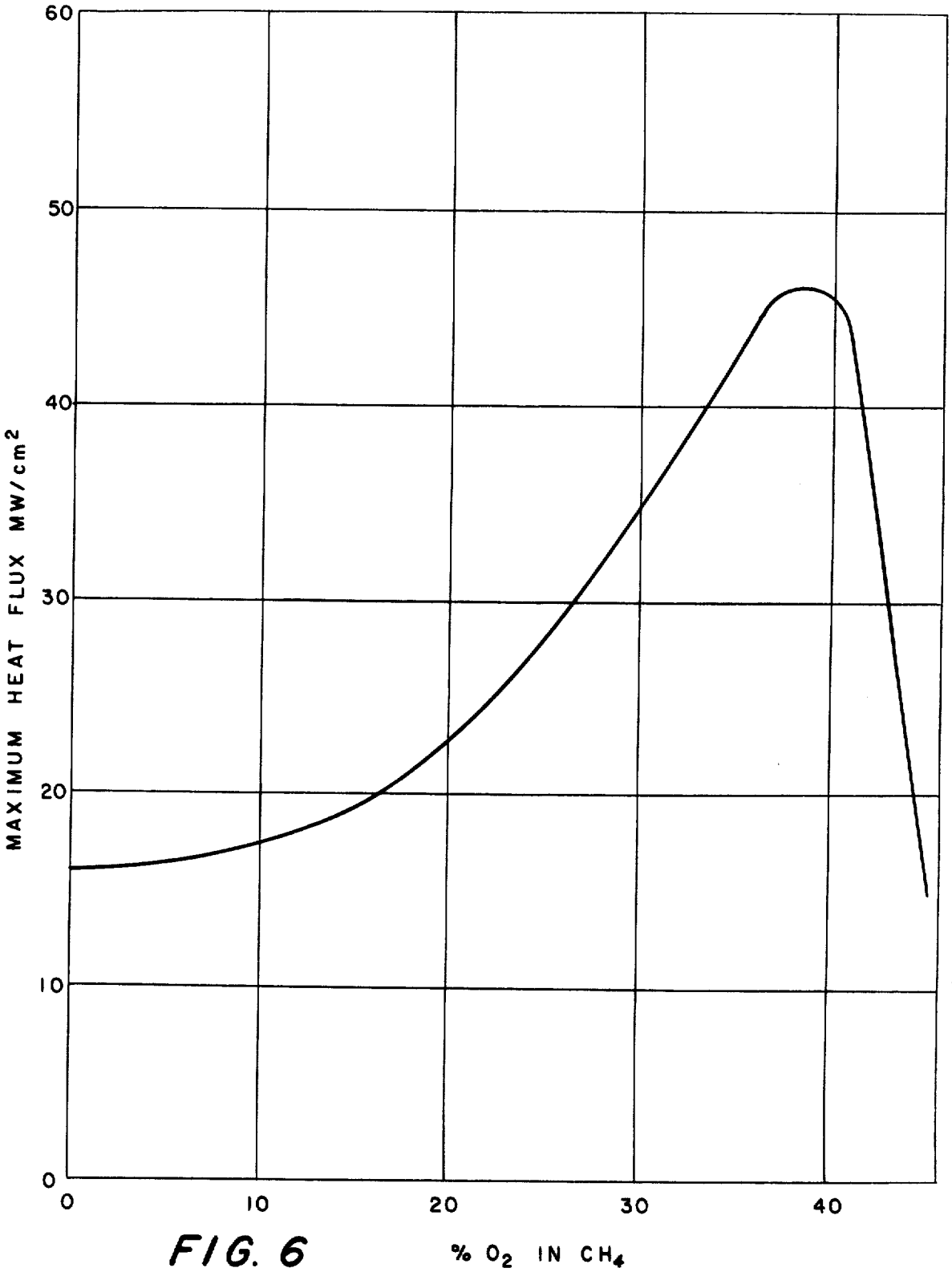
FIG. 6 is a curve relating oxygen content in methane/oxygen flame to radiant heat transfer.

The apparatus used in the work which resulted in this discovery comprised a 23 inch long, 0.5 inch diameter iron pipe which was appropriately connected at one end to an oxygen supply and a methane supply. The other end of the pipe was connected to the sealed end of a 9.5 inch long, 1.25 inch diameter pipe. A bolometer was placed 60 inches from the center line of the flame which exited from the 1.25 inch diameter pipe. With only methane flowing in the pipe, a flame was established. Thereafter, the oxygen supply was added and readings on the bolometer were recorded for various oxygen flow rates. The methane flow rate was maintained at 270 CFH. The information thus obtained is presented in the curve of FIG. 6. As may be noted from FIG. 6, a mixture of methane and 30 to 40% by volume of oxygen increased the radiant heat transfer from the flame by more than 100%. Thus, it will be appreciated that such a mixture could be used as the material 45 in the embodiments of my invention hereinbefore described. Alternatively, it will also be appreciated that my invention as hereinbefore described could be practiced in combination with a main burner flame produced by a methane/oxygen mixture wherein oxygen was present in the range of 30 to 40% by volume, i.e., a fuel/oxygen ratio of approximately 2:1.

The specific and detailed information presented in this example and elsewhere in this specification is for purposes of illustration only, and such alterations, modifications and equivalents thereof as would be apparent to those skilled in the art are deemed to fall with the scope and spirit of the invention, bearing in mind that the invention is defined by the following claims.

What is claimed is:

1. In a method for operating a reverberatory furnace wherein a gaseous fuel is combusted to produce a flame, and wherein a furnace charge of metallic ore is heated by radiation from the furnace hot gases, the improvement which comprises:

introducing to the furnace separate from said furnace fuel, at one or more locations downstream of said flame which are spaced from said charge but below the axis of the flame, and at an aggregate rate from all locations of about 1 to 10% the rate of gaseous fuel, an unsaturated gaseous hydrocarbon having a carbon to hydrogen weight ratio of at least about 6 which exothermically cracks inside said furnace to yield hydrogen and carbon particles in said hot gases, whereby radiant heat transfer from said gases to the charge is increased.

2. The method of claim 1 wherein the hydrocarbon is introduced at a rate of about 2 to 4% the rate of gaseous fuel.

3. In a method for operating a reverberatory furnace wherein a fuel is combusted to produce a flame at an end of said furnace, and where a change of copper-containing ore is heated at least in part by radiation from the furnace gases, the improvement which comprises:

injecting into the furnace an unsaturated gaseous hydrocarbon which exothermically cracks at the temperatures prevailing in said furnace to yield hydrogen and carbon particles and which has a carbon to hydrogen weight ratio of at least about 8, said carbon particles increasing the emissivity of the furnace gases whereby radiant heat transfer from said gases to said charge is increased, said hydrocarbon being introduced to said furnace in amounts effective to increase the emissivity of the furnace gas, and at one or more locations separate from that at which said fuel is introduced, said locations being downstream of said flame, below the axis of the flame and spaced from said charge and the roof of said furnace by a distance of at least about 10% and 25%, respectively, of the distance between the charge and the roof at said location.

4. The method of claim 3 wherein the fuel is a gas, and the hydrocarbon is introduced in an aggregate volumetric amount for all locations of about 1 to 10% the volume of fuel gas introduced to said furnace.

* * * * *